US006820389B1

(12) United States Patent
Macchietto

(10) Patent No.: US 6,820,389 B1
(45) Date of Patent: Nov. 23, 2004

(54) SUPPORT POLE HAVING A TRAFFIC SIGNAL SUPPORT ARM ATTACHED THERETO

(75) Inventor: Carl J. Macchietto, Omaha, NE (US)

(73) Assignee: Valmont Industries, Inc., Valley, NE (US)

( * ) Notice: Subject to any disclaimer, the term of this patent is extended or adjusted under 35 U.S.C. 154(b) by 11 days.

(21) Appl. No.: 10/393,605

(22) Filed: Mar. 20, 2003

(51) Int. Cl.[7] ..... E04C 3/30

(52) U.S. Cl. ..... 52/736.1; 52/736.4; 52/292; 52/296; 248/156; 248/511

(58) Field of Search ..... 248/158, 156, 248/511, 512, 519, 522; 52/736.1, 736.4, 292, 296

(56) References Cited

U.S. PATENT DOCUMENTS

| | | | | | |
|---|---|---|---|---|---|
| 3,050,620 | A | * | 8/1962 | Schlosser et al. | 362/431 |
| 3,552,698 | A | * | 1/1971 | Kinney | 248/158 |
| 3,574,375 | A | * | 4/1971 | Scott | 403/104 |
| 3,630,474 | A | * | 12/1971 | Minor | 52/98 |
| 3,645,057 | A | * | 2/1972 | Kaplan | 52/295 |
| 3,839,835 | A | * | 10/1974 | Meyer | 52/296 |
| 4,055,374 | A | * | 10/1977 | Barber, Jr. | 445/2 |
| 4,295,308 | A | * | 10/1981 | Korfanta | 52/296 |
| 4,878,160 | A | * | 10/1989 | Reneau et al. | 362/269 |
| 5,481,846 | A | | 1/1996 | Macchietto | 52/720.1 |
| 5,641,141 | A | * | 6/1997 | Goodwin | 248/218.4 |
| 5,878,540 | A | * | 3/1999 | Morstein | 52/296 |
| 6,216,414 | B1 | * | 4/2001 | Feldberg | 52/736.1 |
| 6,308,857 | B1 | * | 10/2001 | Heimbach et al. | 220/592 |
| 6,640,517 | B2 | * | 11/2003 | Mitchell | 52/736.1 |
| 6,685,154 | B1 | * | 2/2004 | Blyth et al. | 248/512 |

OTHER PUBLICATIONS

Copies of two photographs of traffic poles taken in Pittsburgh, Pennsylvania, Undated.

* cited by examiner

*Primary Examiner*—Leslie A. Braun
*Assistant Examiner*—Steven M. Marsh
(74) *Attorney, Agent, or Firm*—Thomte, Mazour & Niebergall; Dennis L. Thomte

(57) ABSTRACT

A support pole having a traffic signal support arm secured thereto wherein the connection between the lower end of the support pole and its base plate is strengthened by the use of a strengthening ring welded thereto and also wherein the connection of the support arm to the support pole is strengthened through the use of a strengthening ring provided at the inner end of the support arm. The connections described above also enhance the fatigue strength of the support pole.

39 Claims, 5 Drawing Sheets

SUPPORT POLE HAVING A TRAFFIC SIGNAL SUPPORT ARM ATTACHED THERETO

BACKGROUND OF THE INVENTION

1. Field of the Invention

This invention relates to a support pole and a means for attaching a traffic signal support arm thereto. Further, the invention relates to a means for strengthening the connection of the support arm to the pole as well as strengthening the connection of the pole to a base plate which is mounted on a concrete footing.

2. Description of the Related Art

In many cases, it is desirable or necessary to position a traffic signal light over a roadway. In some cases, the traffic signal is supported by cables strung between a pair of poles which are located on opposite sides of the roadway. In other instances, an upstanding pole is positioned at one side of the roadway and has a traffic signal support arm secured thereto which extends outwardly therefrom over the roadway with the traffic signal being supported thereon. In some cases, the inner end of the support arm is welded to a flat mounting plate with that mounting plate being bolted to a flat support plate which is either welded to the pole or which is clamped onto the pole. In some cases, the support plate on the pole is vertically disposed and in other situations the support plate is slightly inclined with respect to the vertical. Further, in some cases, the inner end of the support arm is shaped or coped to conform to the outer surface of an arcuate support plate which is clamped onto the pole with the support arm being welded to the outer surface of the arcuate support plate.

In those structures wherein a flat support plate is mounted on the pole, the most common method of attaching the support arm to the pole is to weld the mounting plate to the inner end of the support arm by inserting the inner end of the support arm into a circular opening formed in the mounting plate with the outer surface of the support arm being welded to the mounting plate completely around the circumference of the support arm. In some cases, the arm is attached to the plate using a partial or full penetrating groove butt weld. Inasmuch as the support arm is normally a tapered tube of thin wall construction, separation of the support arm from the mounting plate sometimes occurs at the location where the support arm is welded to the mounting plate. Separation occurs because the wall of the support arm cracks adjacent to the outside weld due to fatigue stress induced by cyclic loading created by wind gusts, vibration due to vortex shedding or galloping, or air movement caused by vehicular traffic.

The lower end of the support pole for the traffic signal support arm normally has a flat base plate welded thereto with the base plate being secured to a suitable concrete footing or the like by means of anchor bolts. The support pole is welded to the base plate in generally the same fashion as the support arm is welded to its mounting plate. The prior art support poles have experienced some cracking in the area immediately above the base plate in the pole wall adjacent to the weld. In some cases, the lower end of the support pole is received within a circular opening formed in the base plate. In other cases, the lower end of the support pole is butt welded to the upper surface of the base plate using a partial or full penetration groove weld.

SUMMARY OF THE INVENTION

An improved support pole having a traffic signal support arm attached thereto is described. In particular, a means is described which strengthens the connection between the support pole and its supporting base plate and a means is also provided for strengthening the connection between the support arm and the pole. A horizontally disposed base plate is provided which is adapted to be attached to a footing. The base plate has a circular opening formed therein which receives the lower end of the pole member with the lower end of the pole member being welded to the base plate within the circular opening. In some cases, the lower end of the support pole is butt welded to the upper surface of a flat base plate. A first strengthening ring, having upper and lower ends, embraces the pole member above the base plate. The upper end of the first strengthening ring is welded to the exterior surface of the pole member. The lower end of the first strengthening ring is welded to the exterior surface of the pole member above the base plate and is welded to the upper surface of the base plate.

A support plate is secured to the pole member at one side there above the lower end thereof. A mounting plate is secured to the support plate and has a circular opening formed therein which receives the inner end of an elongated support arm. The inner end of the support arm is welded to the mounting plate within the circular opening formed therein. In some cases, the inner end of the support arm is butt welded to the outer surface of the mounting plate. A second strengthening ring embraces the support arm outwardly of the mounting plate and has an inner end and an outer end. The outer end of the second strengthening ring is welded to the exterior surface of the support arm. The inner end of the second strengthening ring is welded to the mounting plate and to the exterior surface of the support arm. All of the welds described above are continuous weldments. The use of the second strengthening ring between the inner end of the support arm and the mounting plate strengthens the connection between the support arm and the mounting plate to prevent separation thereof. The use of the first strengthening ring between the lower end of the pole and the base plate strengthens the connection between the pole member and the base plate to prevent separation thereof.

It is a principal object of the invention to provide an improved means for attaching a traffic signal support arm to a pole.

A further object of the invention is to provide an improved means for attaching the lower end of a support pole to a base plate.

Still another object of the invention is to provide an improved means for attaching a roadway light support arm, a sign support arm or a camera support arm to a support pole.

Still another object of the invention is to provide a means for attaching a traffic signal support arm to a mounting plate at the inner end thereof through the use of a strengthening ring which embraces the inner end of the support arm and which is welded to the support arm and to the mounting plate.

These and other objects will be apparent to those skilled in the art.

DESCRIPTION OF THE PREFERRED EMBODIMENT

Figure 1:
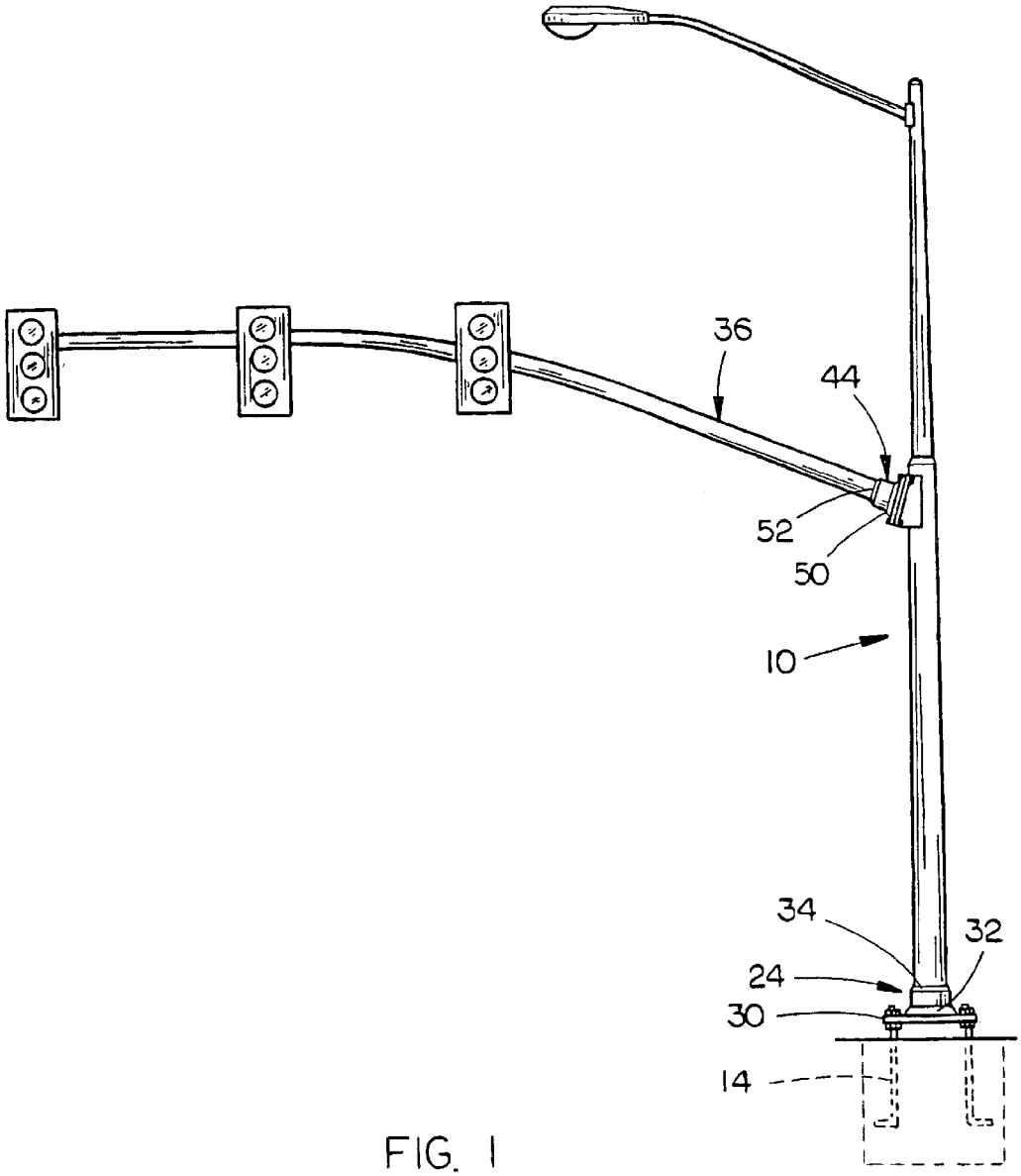
FIG. 1 is a side view of a support pole having a traffic signal support arm secured thereto with the connection of the support pole to the base plate and the connection of the support arm and the support pole being strengthened by the invention therein.
Figure 2:
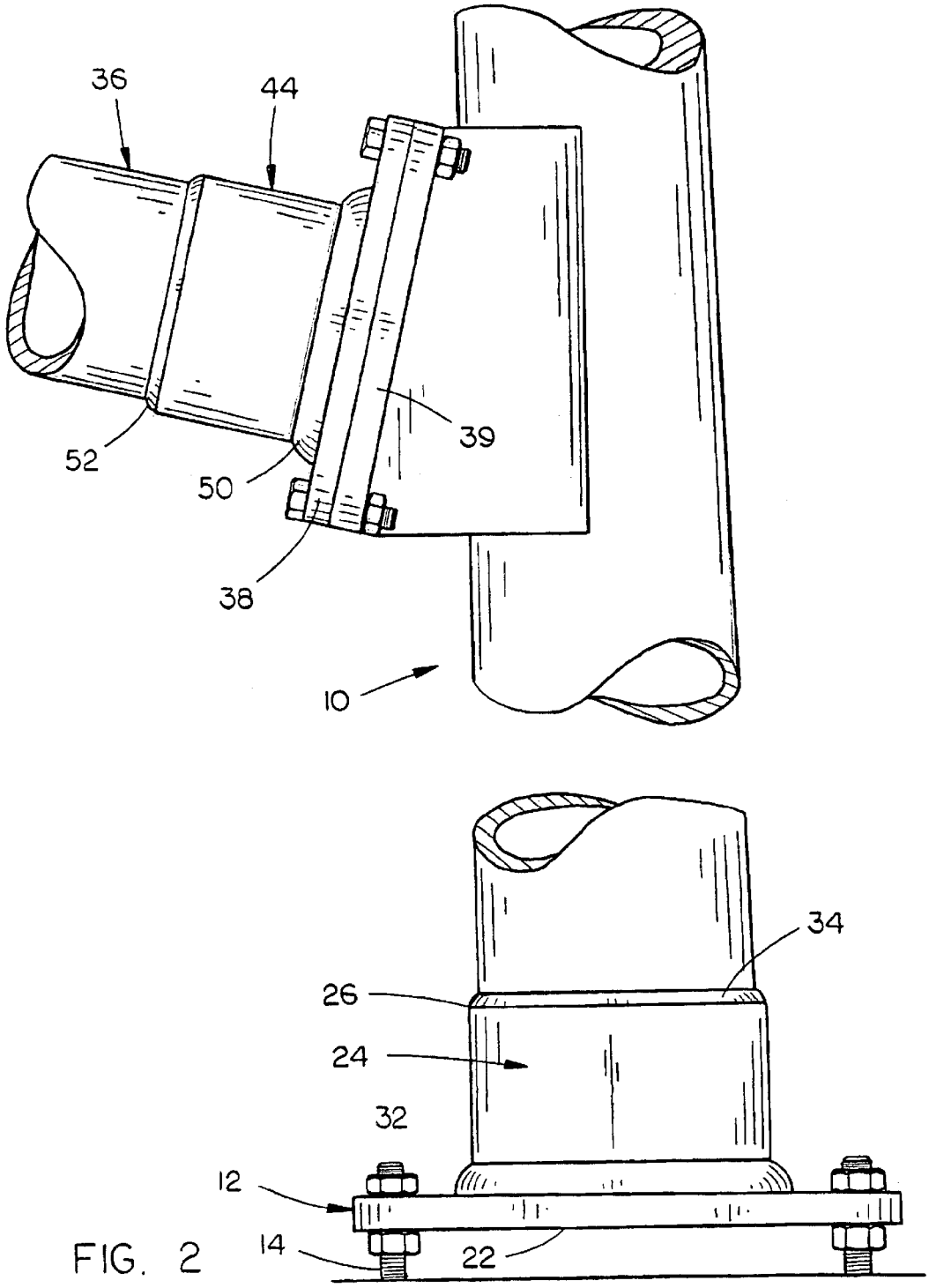
FIG. 2 is an enlarged partial side view of the connections of FIG. 1.
Figure 3:
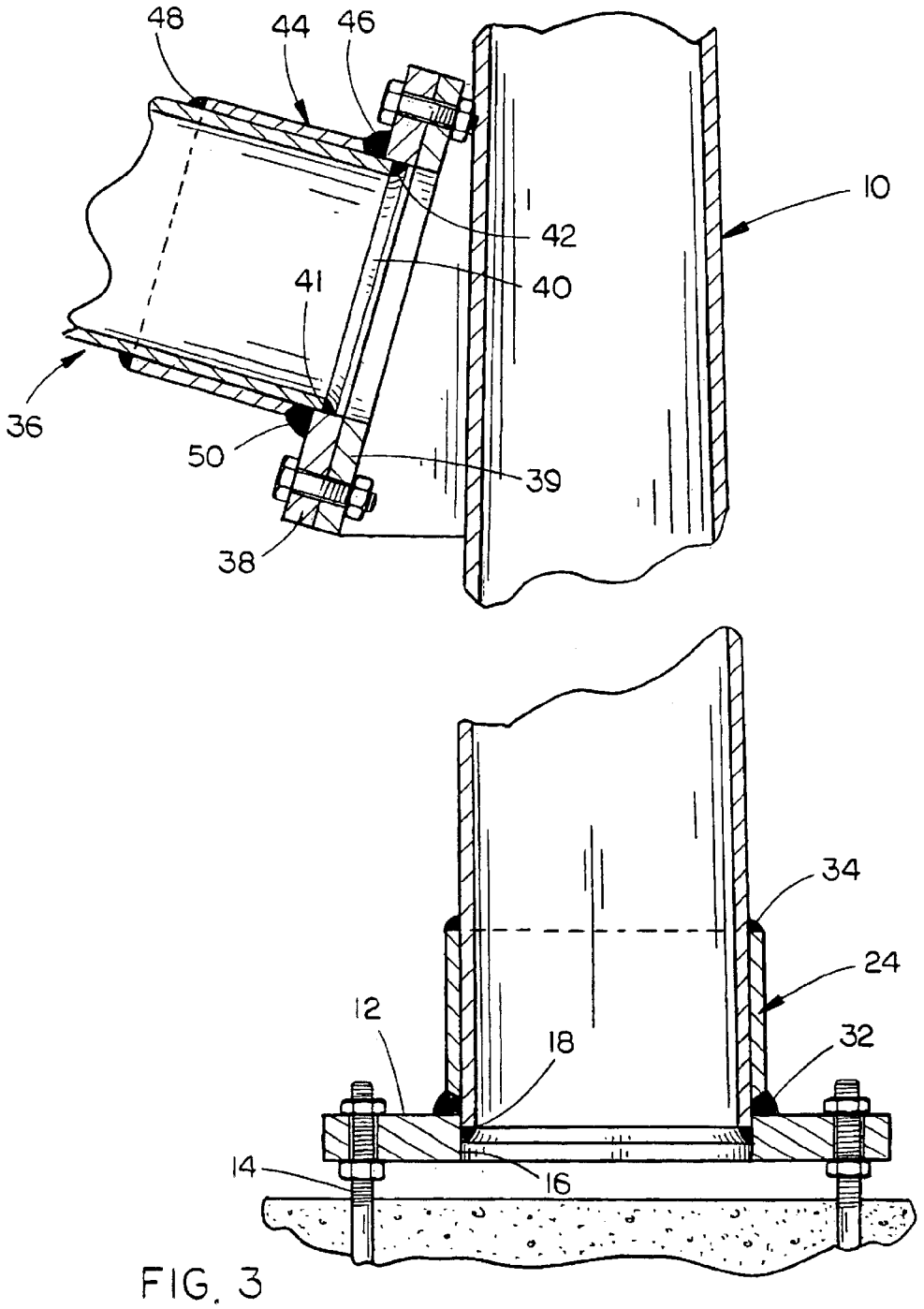
FIG. 3 is a sectional view of the connections of FIG. 1.
Figure 4:
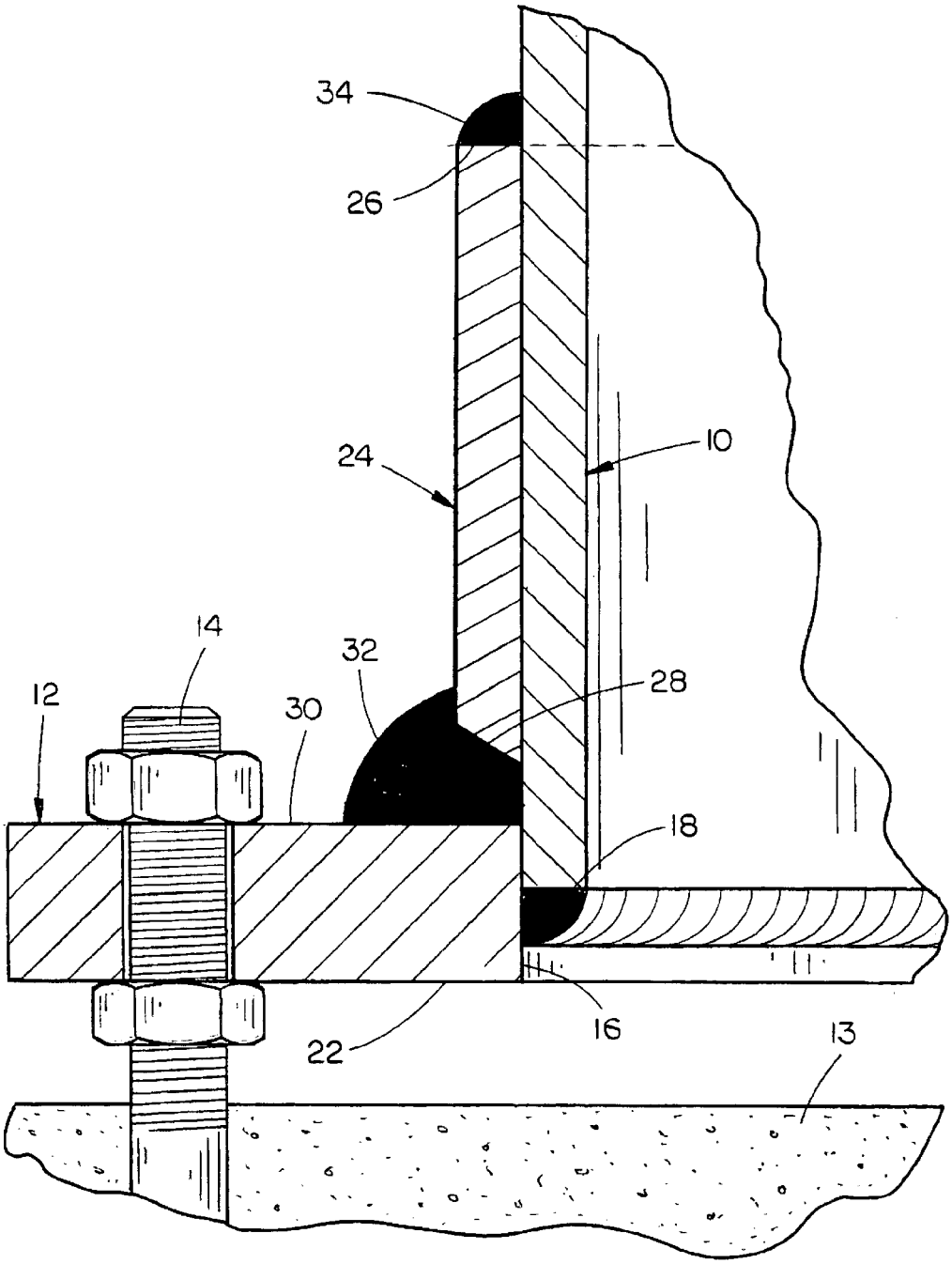
FIG. 4 is a sectional view illustrating the connection between the lower end of the support pole and the base plate.
Figure 5:
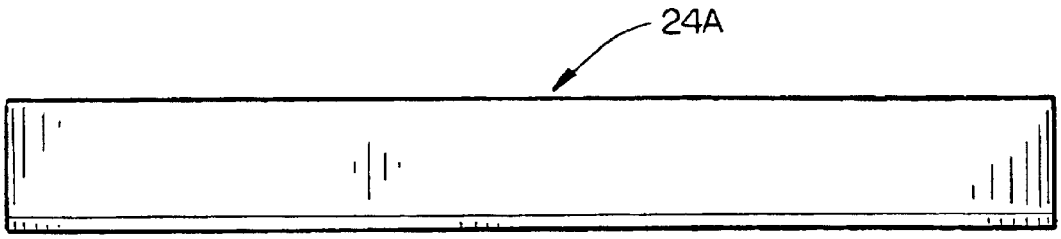
FIG. 5 is a plan view of one-half of a strengthening ring when the ring is of welded two-piece construction.
Figure 6:
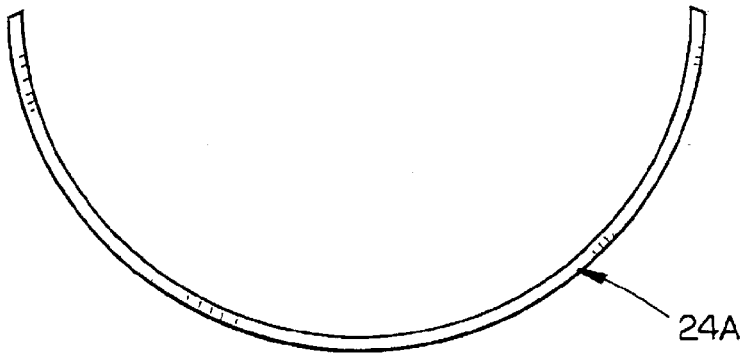
FIG. 6 is a top view of the ring half of FIG. 5.
Figure 7:
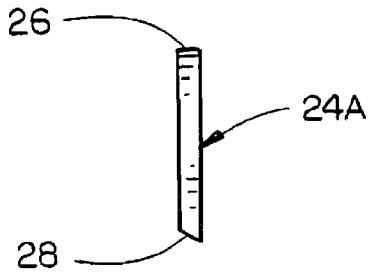
FIG. 7 is an end view of the ring half of FIG. 5.

The drawings illustrate a conventional support pole such as is used for attaching a traffic signal support arm thereto, a roadway light support arm, a sign support arm or a camera support arm thereto. As seen in the drawings, the support pole 10 is associated with a flat, generally square base plate 12 which is secured to a suitable concrete footing 13 or the like by means of anchor bolts 14. Base plate 12 is sometimes secured to steel shafts extending upwardly from the ground as well.

Base plate 12 has a circular opening 16 formed therein which at least partially receives the lower end 18 of support pole 10. There are possibly some situations wherein the lower end 18 of pole 10 will be flush or semi-flush with the bottom surface 22 of base plate 12. In other situations, the lower end 18 of pole 10 may be butt welded to the upper surface of base plate 12. In any event, the lower end 18 of pole 10 is welded to plate 12 in a continuous fashion, as illustrated in the drawings. Normally, the pole 10 will be constructed of a steel or aluminum material.

The numeral 24 refers to a two-piece strengthening ring comprised of a pair of identical semi-circular ring portions 24A. The ring 24 may also be of one-piece construction. For purposes of description, ring 24 will be described as having an upper end 26 and a lower end 28. Preferably, the strengthening ring 24 has the same wall thickness as the pole 10 and is constructed of the same metal material as the pole 10. Ring 24 may have a beveled surface 28 at its lower end. If ring 24 is of two-piece construction, the opposite ends of ring portions 24A are also beveled to aid in welding the ends of ring portions 24A together to form ring 24. Strengthening ring 24 embraces pole 10, as seen in the drawings, with the beveled lower end 28 thereof being spaced above the top surface 30 of base plate 12 to expose a portion of the exterior surface of pole 10 below the lower end 28 of strengthening ring 24. The beveled lower end 28 of strengthening ring 24 is welded, in a continuous fashion, to the exterior surface of pole 10, below the lower end 28 of strengthening ring 24, and to the top surface 30 of base plate 12 so that the weldment continuously extends around the lower end of the strengthening ring 24, as illustrated in the drawings. The upper end 26 of strengthening ring 24 is welded in a continuous fashion to the exterior surface of pole 10. The weldment at the lower end of the strengthening ring 24 will be referred to by the reference numeral 32 while the weldment at the upper end of the strengthening ring 24 will be referred to by the reference numeral 34.

Preferably, the lower end 28 of strengthening ring 24 is spaced approximately one-eighth to one-quarter inch above the top surface 30 of base plate 12. Preferably, the height of the strengthening ring 24 is approximately four to eight inches although there may be situations where the height of the strengthening ring 24 will be less than six inches and other situations where the strengthening ring 24 will reach a height of twelve inches. In most situations, it is believed that a height of six to eight inches will satisfactorily strengthen the connection between the lower end of the support pole 10 and the base plate 12.

The numeral 36 refers to a conventional traffic signal support arm but it should be understood that the support arm 36 could support a variety of different objects such as roadway lights, signs, cameras, etc. There are many different ways to affix the inner end of the support arm to the support pole 10 but most support arms will be secured to the support pole through the use of a mounting plate 38 provided at the inner end of the support arm 36 and which is either secured to a matching support plate 39 on the support pole 10 or some other structure. Plate 38 is provided with a circular opening 40 formed therein which partially receives the inner end 41 of support arm 36. The inner end 41 of support arm 36 is welded to the plate 38 within the circular opening with the weldment being referred to generally by the reference numeral 42. There will be some situations wherein the plate will be arcuate rather than flat with the inner end of the support arm 36 being coped to correspond to the arcuate plate with the arcuate plate and the support arm being welded together. Further, the inner end of arm 36 may be butt welded to the outer surface of plate 38.

The numeral 44 refers to a strengthening ring which may be of two-piece or one-piece construction. Ring 44 may have a beveled an inner end 46 and an outer end 48. The inner end 46 of strengthening ring 44 is spaced outwardly approximately one-eighth to one-quarter inch from plate 38 so as to expose a portion of the exterior surface of the support arm 36. The inner end 41 of support arm 36 is welded to the exterior surface of support arm 36 inwardly of inner end 46 of strengthening ring 44 and to the outer surface of plate 38 with that weldment being identified by the reference numeral 50. The outer end of strengthening ring 44 is welded to the exterior surface of support arm 36 at 52 with that weldment being identified by the reference numeral 52. The weldments 50 and 52 are preferably of the continuous type. The strengthening ring 44 strengthens the connection between the support arm 36 and the plate 38 to prevent separation thereof or to prevent cracking of the component parts. The strengthening ring 24 improves the connection between the lower end of the support pole 10 and the base plate 12 to prevent separation thereof. Each of the strengthening rings enhances the fatigue strength of the pole.

Although it is preferred that the strengthening ring 24 be provided at the lower end of the support pole 10 and the strengthening ring 44 be provided at the inner end of the support arm 36, there may be situations wherein it will not be necessary to utilize both of the strengthening rings although it is preferred that both the strengthening rings be utilized.

Thus it can be seen that the invention accomplishes at least all of its stated objectives.

What is claimed is:

1. A support pole, comprising:

a horizontally disposed base plate for attachment to a footing and having upper and lower ends;

a hollow pole member having upper and lower ends;

said lower end of said pole member being welded to said base plate;

a strengthening ring, having upper and lower ends, embracing said pole member above said base plate;

said lower end of said strengthening ring being spaced above said upper end of said base plate;

said upper end of said strengthening ring being welded to the exterior surface of said pole member;

said lower end of said strengthening ring being welded to said base plate and to the exterior surface of said pole member above said base plate.

2. The support pole of claim 1 wherein said upper end of said strengthening ring is welded to the exterior surface of said pole member in a continuous fashion.

3. The support pole of claim 1 wherein said lower end of said strengthening ring is welded to the exterior surface of said pole member in a continuous fashion.

4. The support pole of claim 2 wherein said lower end of said strengthening ring is welded to the exterior surface of said pole member in a continuous fashion.

5. The support pole of claim 1 wherein said strengthening ring has a wall thickness which is substantially the same as the wall thickness of said pole member.

6. The support pole of claim 1 wherein said lower end of said pole member is disposed above said lower end of said base plate.

7. The support pole of claim 1 wherein said strengthening ring has a height which is less than twelve inches.

8. The support pole of claim 1 wherein said strengthening ring has a height of approximately four to eight inches.

9. The support pole of claim 1 wherein said lower end of said strengthening ring is beveled.

10. The support pole of claim 1 wherein said strengthening ring is comprised of a pair of semi-circular ring portions welded together.

11. The support pole of claim 10 wherein each of said ring portions has beveled lower ends.

12. The support pole of claim 1 wherein said base plate has a circular opening formed therein which receives said lower end of said pole member and wherein said lower end of said pole member is welded to said base plate within said circular opening.

13. In combination:

an upstanding pole member having upper and lower ends;

a plate secured to said pole member at one side thereof above the lower end thereof which has an inner side, an outer side, an upper end and a lower end;

an elongated hollow support arm having inner and outer ends;

said inner end of said support arm being secured to said plate;

a strengthening ring embracing said support arm outwardly of said plate and having an inner end and an outer end;

said inner end of said strengthening ring being spaced outwardly of said outer side of said plate;

said outer end of said strengthening ring being welded to the exterior surface of said support arm;

said inner end of said strengthening ring being welded to the said plate and to the exterior surface of said support arm.

14. The combination of claim 13 wherein said outer end of said strengthening ring is welded to the exterior surface of said support arm in a continuous fashion.

15. The combination of claim 13 wherein said inner end of said support arm is welded to the exterior surface of said support arm in a continuous fashion.

16. The combination of claim 13 wherein said inner end of said support arm is disposed outwardly of said outer side of said plate.

17. The combination of claim 13 wherein the distance between said inner and outer ends of said strengthening ring is less than twelve inches.

18. The combination of claim 13 wherein the distance between said inner and outer ends of said strengthening ring is approximately four to eight inches.

19. The combination of claim 13 wherein said plate has a circular opening formed therein and wherein said inner end of said support arm is received by said circular opening.

20. The combination of claim 19 wherein said inner end of said support arm is welded to said plate within said circular opening.

21. The combination of claim 13 wherein said inner end of said strengthening ring is beveled.

22. The combination of claim 13 wherein said strengthening ring is comprised of a pair of semi-circular ring portions welded together.

23. In combination:

an upstanding pole member having upper and lower ends;

a plate secured to said pole member at one side thereof above the lower end thereof which has an inner side, an outer side, an upper end and a lower end;

an elongated hollow support arm having inner and outer ends;

said inner end of said support arm being secured to said plate;

a first strengthening ring embracing said support arm outwardly of said plate and having an inner end and an outer end;

said inner end of said strengthening ring being spaced outwardly of said outer side of said plate;

said outer end of said first strengthening ring being welded to the exterior surface of said support arm;

said inner end of said first strengthening ring being welded to the said plate and to the exterior surface of said support arm;

a horizontally disposed base plate for attachment to a footing and having upper and lower ends;

said lower end of said pole member being secured to said base plate;

a second strengthening ring, having upper and lower ends, embracing said pole member above said base plate;

said lower end of said strengthening ring being spaced above said upper end of said base plate;

said upper end of said second strengthening ring being welded to the exterior surface of said pole member;

said lower end of said second strengthening ring being welded to said base plate and to the exterior surface of said pole member above said base plate.

24. The support pole of claim 23 wherein said upper end of said second strengthening ring is welded to the exterior surface of said pole member in a continuous fashion.

25. The support pole of claim 23 wherein said lower end of said second strengthening ring is welded to the exterior surface of said pole member in a continuous fashion.

26. The support pole of claim 23 wherein said second strengthening ring has a wall thickness which is substantially the same as the wall thickness of said pole member.

27. The support pole of claim 23 wherein said lower end of said second strengthening ring is disposed above said upper end of said base plate.

28. The support pole of claim 23 wherein said second strengthening ring has a height which is less than twelve inches.

29. The support pole of claim 23 wherein said second strengthening ring has a height of approximately four to eight inches.

30. The combination of claim 23 wherein said outer end of said first strengthening ring is welded to the exterior surface of said support arm in a continuous fashion.

31. The combination of claim 23 wherein said inner end of said first strengthening ring is welded to the exterior surface of said support arm in a continuous fashion.

32. The combination of claim 23 wherein said inner end of said first strengthening ring is disposed outwardly of said outer side of said plate.

33. The combination of claim 23 wherein the distance between said inner and outer ends of said first strengthening ring is less than twelve inches.

34. The combination of claim 23 wherein the distance between said inner and outer ends of said first strengthening ring is approximately four to eight inches.

35. The combination of claim 23 wherein said plate has a circular opening formed therein and wherein said inner end of said support arm is received by said circular opening in said plate.

36. The combination of claim 35 wherein said inner end of said support arm is welded to said plate within said circular opening formed therein.

37. The combination of claim 23 wherein said first strengthening ring has a beveled inner end.

38. The combination of claim 23 wherein said second strengthening ring has a beveled lower end.

39. The combination of claim 23 wherein each of said first and second strengthening rings is comprised of a pair of semi-circular ring portions welded together.

* * * * *